US012800175B2

(12) United States Patent
Wang

(10) Patent No.: US 12,800,175 B2
(45) Date of Patent: Nov. 17, 2026

(54) METHOD FOR ESTIMATING EXTERNAL STATIC PRESSURE IN AIR DUCT OF AIR CONDITIONING SYSTEM AND METHOD FOR CONTROLLING AIR CONDITIONING SYSTEM

(71) Applicant: Zhongshan Broad-Ocean Motor Co., Ltd., Zhongshan (CN)

(72) Inventor: Jizhong Wang, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 429 days.

(21) Appl. No.: 18/518,403

(22) Filed: Nov. 22, 2023

(65) Prior Publication Data

US 2024/0085051 A1 Mar. 14, 2024

Related U.S. Application Data

(63) Continuation-in-part of application No. PCT/CN2022/119516, filed on Sep. 19, 2022.

(30) Foreign Application Priority Data

May 30, 2022 (CN) ..... 202210595496.6

(51) Int. Cl.
*F24F 11/75* (2018.01)
*F24F 11/38* (2018.01)
(Continued)

(52) U.S. Cl.
CPC ..... *F24F 11/75* (2018.01); *F24F 11/38* (2018.01); *F24F 11/39* (2018.01); *F24F 2110/00* (2018.01); *F24F 2140/60* (2018.01)

(58) Field of Classification Search
None
See application file for complete search history.

(56) References Cited

U.S. PATENT DOCUMENTS 4,806,833 A * 2/1989 Young ..... F04D 27/004 318/400.08
5,736,823 A * 4/1998 Nordby ..... F04D 27/004 388/930
(Continued)

FOREIGN PATENT DOCUMENTS

CA 2759956 C * 9/2018 ..... F04D 29/601
CN 204026789 U * 12/2014 ..... F24C 15/20
(Continued)

*Primary Examiner* — Mohammad Ali
*Assistant Examiner* — Kelvin Booker
(74) *Attorney, Agent, or Firm* — MATTHIAS SCHOLL P.C.; Matthias Scholl

(57) ABSTRACT

A method for estimating an external static pressure (ESP) in an air duct, includes: disposing a permanent magnetic (PM) motor and a fan in an air duct, where the PM motor includes a stator assembly, a permanent-magnet rotor assembly, and a motor controller; the motor controller includes a micro control unit (MCU); and the fan is powered by the PM motor; applying a constant current to the PM motor so that the air duct outputs a constant volumetric airflow rate in a unit of cubic feet per minute (CFM); and calculating an external static pressure (ESP) on the air duct using two variables: the constant volumetric airflow rate (CFM) of the air duct and an input power (POWER) of the PM motor.

5 Claims, 10 Drawing Sheets

(51) Int. Cl.

| | |
|---|---|
| ***F24F 11/39*** | (2018.01) |
| *F24F 110/00* | (2018.01) |
| *F24F 140/60* | (2018.01) |

(56) References Cited

U.S. PATENT DOCUMENTS

| | | | | |
|---|---|---|---|---|
| 8,814,639 | B1 * | 8/2014 | Mecozzi | F04D 17/16 454/238 |
| 8,920,132 | B2 * | 12/2014 | Havard, Jr. | F04D 27/004 417/43 |
| 9,835,350 | B2 * | 12/2017 | Hu | F24F 11/62 |
| 10,233,933 | B2 * | 3/2019 | Wang | F04D 27/001 |
| 2010/0256821 | A1 * | 10/2010 | Jeung | G05B 15/02 318/504 |
| 2011/0146651 | A1 * | 6/2011 | Puranen | F24D 5/04 126/116 A |
| 2012/0131944 | A1 * | 5/2012 | Havard, Jr. | F04D 29/601 62/426 |
| 2012/0171050 | A1 | 7/2012 | Havard, Jr. | |
| 2013/0288589 | A1 * | 10/2013 | Hu | F04D 15/0066 454/256 |
| 2013/0288590 | A1 * | 10/2013 | Hu | G05B 19/041 454/256 |
| 2013/0320889 | A1 * | 12/2013 | Zhang | H02P 21/14 310/156.56 |
| 2013/0345995 | A1 * | 12/2013 | Shah | G01F 1/05 702/45 |
| 2014/0133999 | A1 * | 5/2014 | Hu | F04D 27/004 417/44.1 |
| 2015/0211760 | A1 * | 7/2015 | Wang | F04D 27/001 417/44.11 |
| 2015/0219377 | A1 | 8/2015 | Goel | |
| 2016/0040679 | A1 * | 2/2016 | Wang | F04D 27/001 702/45 |
| 2016/0116180 | A1 * | 4/2016 | Hu | G05B 15/02 700/276 |
| 2016/0117907 | A1 * | 4/2016 | Wang | F24F 1/00 340/607 |
| 2016/0281723 | A1 * | 9/2016 | Zhang | F24F 11/77 |
| 2017/0038089 | A1 * | 2/2017 | Wang | F24F 11/75 |
| 2018/0209433 | A1 * | 7/2018 | Sun | F04D 25/06 |
| 2021/0207872 | A1 * | 7/2021 | Ishida | F24F 11/49 |
| 2024/0392985 | A1 * | 11/2024 | Greaves | F24F 7/025 |

FOREIGN PATENT DOCUMENTS

| | | | | | |
|---|---|---|---|---|---|
| CN | 104764155 | A | | 7/2015 | |
| CN | 104807152 | A | | 7/2015 | |
| CN | 105629814 | A | | 6/2016 | |
| CN | 107388502 | A | * | 11/2017 | F24F 1/0007 |
| CN | 104807152 | B | * | 5/2018 | F24F 11/75 |
| CN | 211674010 | U | * | 10/2020 | |
| CN | 112443888 | A | | 3/2021 | |
| CN | 112984722 | A | | 6/2021 | |
| CN | 114676657 | A | | 6/2022 | |
| EP | 3489592 | A1 | | 5/2019 | |
| JP | 2013179798 | A | * | 9/2013 | |
| JP | 2013179799 | A | * | 9/2013 | |
| JP | 2013179800 | A | * | 9/2013 | |
| WO | WO-2011019778 | A1 | * | 2/2011 | F04D 27/004 |
| WO | WO-2014139201 | A1 | * | 9/2014 | H02P 6/08 |
| WO | WO-2016065874 | A1 | * | 5/2016 | F24F 11/75 |
| WO | 2017113543 | A1 | | 7/2017 | |

* cited by examiner

METHOD FOR ESTIMATING EXTERNAL STATIC PRESSURE IN AIR DUCT OF AIR CONDITIONING SYSTEM AND METHOD FOR CONTROLLING AIR CONDITIONING SYSTEM

CROSS-REFERENCE TO RELATED APPLICATIONS

This application is a continuation-in-part of International Patent Application No. PCT/CN2022/119516 with an international filing date of Sep. 19, 2022, designating the United States, and further claims foreign priority benefits to Chinese Patent Application No. 202210595496.6 filed May 30, 2022. The contents of all the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a method for estimating the external static pressure in an air duct of an air conditioning system and a method for controlling the air conditioning system.

In residential or commercial heating, ventilation, and air conditioning (also known as HVAC) systems, a system controller acquires data regarding external static pressure (ESP) from different locations in air ducts. The external static pressure (ESP) serves as a vital parameter for the system controller and provides valuable information about the operational performance of the HVAC systems, for example, for the identification of any faulty components and pinpointing a specific area in the air ducts that requires adjustment in airflow. The information is crucial for optimizing the performance of the HVAC systems.

Currently, each air duct is equipped with a filter that is renewed every three months. However, many of these filters are far from being fully clogged within this time frame. By monitoring the changes in static pressure in the air ducts, the level of filter clogging can be determined. The method helps to prevent the replacement of the filters that are not yet clogged, thereby reducing unnecessary expenses.

Static pressure measurement devices are commonly used for measuring the static pressure in the air ducts of HVAC systems. However, the static pressure measurement devices on the market are often bulky and costly. The installation of such a device in each air duct is impractical due to the high expenses, complex wiring, and inconvenient installation involved.

SUMMARY

To solve the aforesaid problems, the first objective of the disclosure is to provide a first method for estimating the external static pressure in an air duct. The method comprises:

disposing a permanent magnetic (PM) motor and a fan in an air duct, wherein the PM motor comprises a stator assembly, a permanent-magnet rotor assembly, and a motor controller; the motor controller comprises a micro control unit (MCU); and the fan is powered by the PM motor;

applying a constant current to the PM motor so that the air duct outputs a constant volumetric airflow rate in a unit of cubic feet per minute (CFM); and calculating an external static pressure (ESP) on the air duct using two variables: the constant volumetric airflow rate (CFM) of the air duct and an input power (POWER) of the PM motor.

In a class of this embodiment, the external static pressure (ESP) on the air duct is calculated using a function of a first-order binary equation: ESP=F(CFM, POWER).

In a class of this embodiment, the first-order binary equation is simplified as follows: $F(X, Y, K)=K0+K1\cdot X+K2\cdot Y+K3\cdot X\cdot Y$, where a variable X is the constant volumetric airflow rate (CFM); a variable Y is the input power (POWER); K0, K1, K2, and K3 are coefficients; and F(X, Y, K) is the external static pressure (ESP).

In a class of this embodiment, the constant volumetric airflow rate (CFM) is determined by a function CFM=F (POWER, V), where POWER is the input power and V is a rotational speed of the PM motor.

The second objective of the disclosure is to provide a second method for controlling a constant volumetric airflow rate of an air conditioning system, the air conditioning system comprising a system controller and a plurality of air ducts disposed at different locations; the method comprising: disposing a permanent magnetic (PM) motor and a fan in each air duct, and the fan being powered by the PM motor; applying a constant current to the PM motor so that the air duct outputs a constant volumetric airflow rate in a unit of cubic feet per minute (CFM); calculating an external static pressure (ESP) on the air duct using two variables: the constant volumetric airflow rate (CFM) of the air duct and an input power (POWER) of the PM motor; transmitting data of the external static pressure (ESP) to the system controller; and analyzing the data to maintain a constant volumetric airflow rate within the air conditioning system.

In a class of this embodiment, the system controller is configured to receive the date of the external static pressure (ESP) measured by PM motors at different locations and provides appropriate instructions to the PM motors to maintain a constant volumetric airflow rate (CFM) within the plurality of air ducts.

The third objective of the disclosure is to provide a third method for determining whether a filter of a conditioning system is clogged and requires replacement, the air conditioning system comprising a system controller and a plurality of air ducts disposed at different locations, and each air duct comprising a filter; the method comprising: disposing a permanent magnetic (PM) motor and a fan in each air duct, and the fan being powered by the PM motor; applying a constant current to the PM motor so that the air duct outputs a constant volumetric airflow rate in a unit of cubic feet per minute (CFM); calculating an external static pressure (ESP) on the air duct using two variables: the constant volumetric airflow rate (CFM) of the air duct and an input power (POWER) of the PM motor; transmitting data of the external static pressure (ESP) to the system controller; and determining whether the filter of the conditioning system is clogged and requires replacement according to the data of the external static pressure (ESP)

In a class of this embodiment, when the data of the external static pressure (ESP) measured by one of the plurality of PM motors under a certain constant volumetric airflow rate (CFM) and a specific input power (POWER) exceeds a preset static pressure threshold (ESPmax), the system controller issues an alarm signal to indicate that the filter at a certain location is clogged and requires replacement.

In a class of this embodiment, during the replacement of a new filter, the system controller records the data of the external static pressure (ESP) measured by one of the plurality of PM motors under a certain constant volumetric airflow rate (CFM) and a specific input power (POWER) as an initial external static pressure, for future big data analysis to identify a potential fault location within the air conditioning system using the recorded data.

The fourth objective of the disclosure is to provide a method for determining whether a fault exists within an air conditioning system, the air conditioning system comprising a system controller and a plurality of air ducts disposed at different locations, and each air duct comprising a filter; the method comprising: disposing a permanent magnetic (PM) motor and a fan in each air duct, and the fan being powered by the PM motor; applying a constant current to the PM motor so that the air duct outputs a constant volumetric airflow rate in a unit of cubic feet per minute (CFM); calculating an external static pressure (ESP) on the air duct using two variables: the constant volumetric airflow rate (CFM) of the air duct and an input power (POWER) of the PM motor; transmitting data of the external static pressure (ESP) to the system controller; and determining whether a fault exists within the air conditioning system according to the data of the external static pressure (ESP).

In a class of this embodiment, the system controller is configured to receive real-time date of the external static pressure (ESP) measured by the plurality of PM motors; and the data is analyzed using big data techniques to identify any fault within the air conditioning system.

The following advantages are associated with the method for estimating an external static pressure (ESP) in an air duct of the disclosure:

1. (1) The PM motor operates under constant current for the estimation of the external static pressure (ESP) on the air duct; the external static pressure (ESP) is determined by two variables: the constant volumetric airflow rate (CFM) of the air duct and the input power (POWER) of the motor. The disclosed methods omit the requirement for extra static pressure measurement devices, and allow real-time estimation of the external static pressure (ESP). The estimated data enables a comprehensive understanding of the operational performance of the HVAC system and facilitates the implementation of appropriate control measures, all achieved without any additional costs or modifications to the product structure.
   (2) By assessing the range and intensity of the external static pressure (ESP), the PM motor generates a constant airflow within the air duct system, thereby ensuring a constant volumetric airflow rate even in case of fluctuations of the external static pressures.
   (3) When the data of the external static pressure ESP measured by any one of the plurality of PM motors, under a constant volumetric airflow rate (CFM) and a specific input power (POWER), exceeds a preset static pressure threshold (ESPmax), the system controller issues an alarm signal to indicate that a filter at a certain location is clogged and requires replacement. The disclosed method helps to prevent the replacement of the filters that are not yet clogged, thereby reducing unnecessary expenses.
   (4) The system controller is configured to receive the real-time data of the external static pressure (ESP) measured by the plurality of PM motors disposed at different locations; and the data is analyzed using big data techniques to identify any faults within the air conditioning system.
   (5) The PM motor supplies the data of the external static pressure (ESP) on the plurality of branch air ducts to the system controller. The data is transmitted remotely through the Internet of Things (IoT) to a centralized computer center for analysis. The process facilitates remote monitoring and enhances the significance of ESP feedback, particularly in commercial environments.

DETAILED DESCRIPTION

To further illustrate the disclosure, embodiments detailing a method for estimating the external static pressure in an air duct of an air conditioning system and a method for controlling the air conditioning system are described below. It should be noted that the following embodiments are intended to describe and not to limit the disclosure.

Example 1

Figure 1:
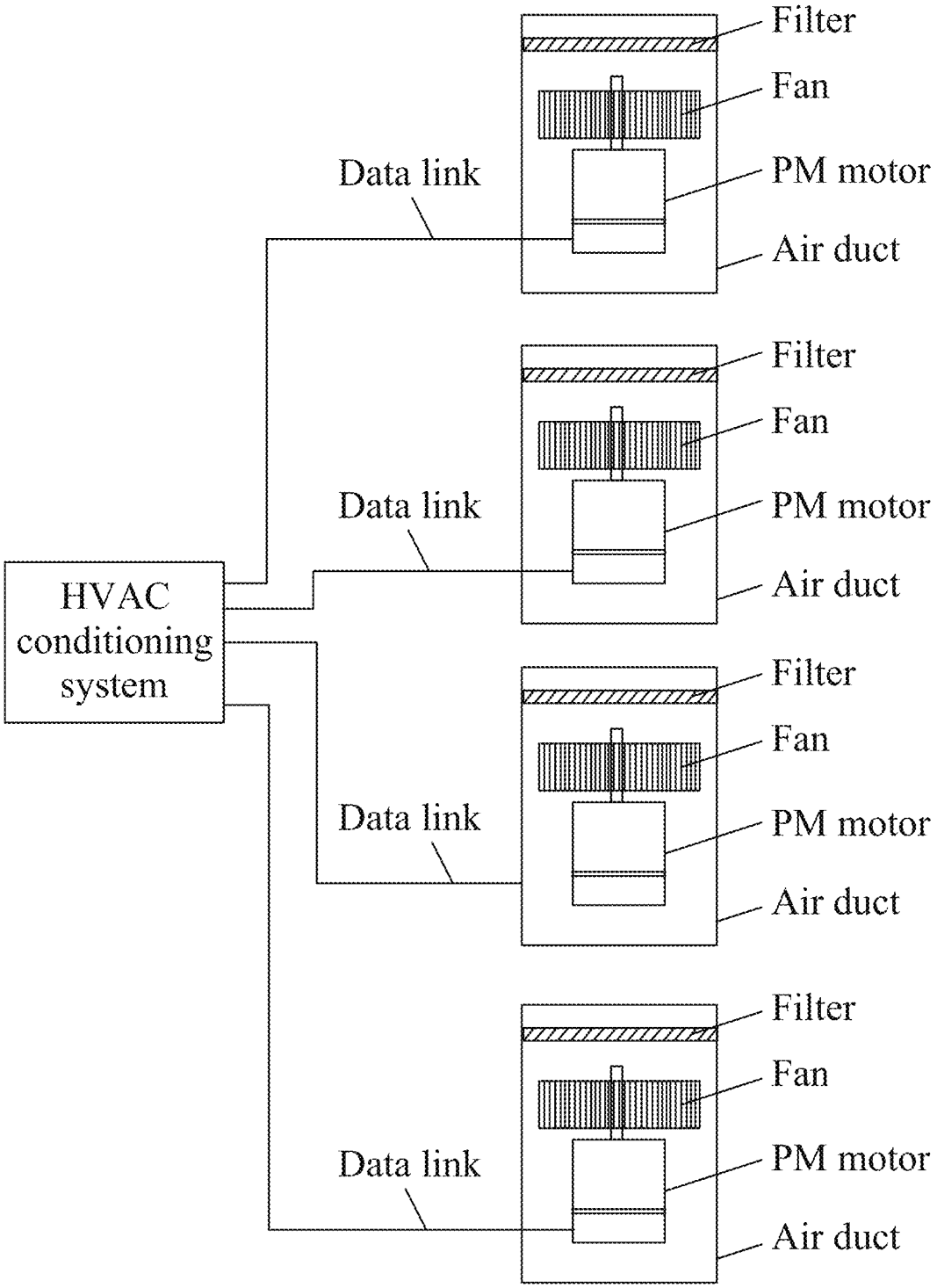
FIG. 1 (Prior art)
FIG. 1 is a schematic diagram of a conventional HVAC system.

Referring to FIG. 1, a conventional HVAC system includes dozens or even hundreds of branch air ducts for distributing airflow to different locations. FIG. 1 shows only four of these branch air ducts. Each branch air duct is equipped with a filter, a fan, and a PM motor. The PM motor is disposed in the branch air duct to power the fan. The conventional HVAC system further includes a system controller communicating with each PM motor through data communication lines. The system controller is used to control each PM motor, thereby regulating the airflow in each branch air duct.

Referring to FIGS. 2, 3, 4, and 5, the PM motor is a sensorless brushless DC motor. The sensorless brushless DC motor comprises a motor unit 1 and a motor controller 2. The motor unit 1 comprises a stator assembly 12, a rotor assembly 13, and a housing assembly 11. The stator assembly 13 is disposed on the housing assembly 11 and comprises a plurality of winding coils. The rotor assembly 13 is disposed inside the stator assembly 12. The motor controller 2 comprises a control box 22 and a control circuit board 21 disposed within the control box 22. The control circuit board 21 generally comprises a power circuit, a micro control unit (MCU), a phase current detection circuit, and an inverter circuit. The power circuit is configured to supply power to different components of the circuit, and the phase current detection circuit is configured to apply the detected phase currents to the MCU. The MCU is configured to control the inverter circuit. The inverter circuit is configured to control the activation and deactivation of the plurality of winding coils.

Figure 6:
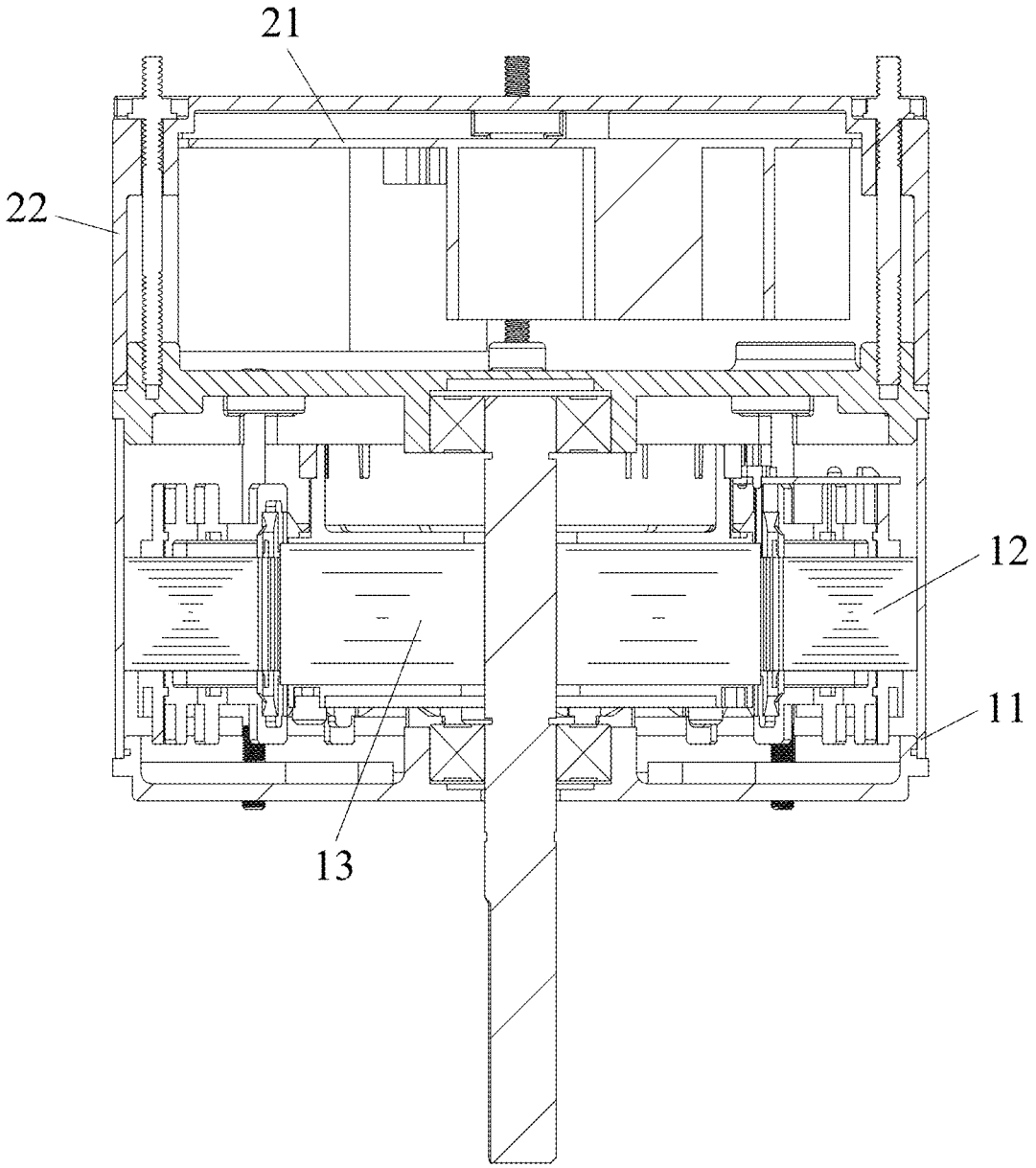
FIG. 6 is a cross-sectional view of a PM motor according to one embodiment of the disclosure.
Figure 7:
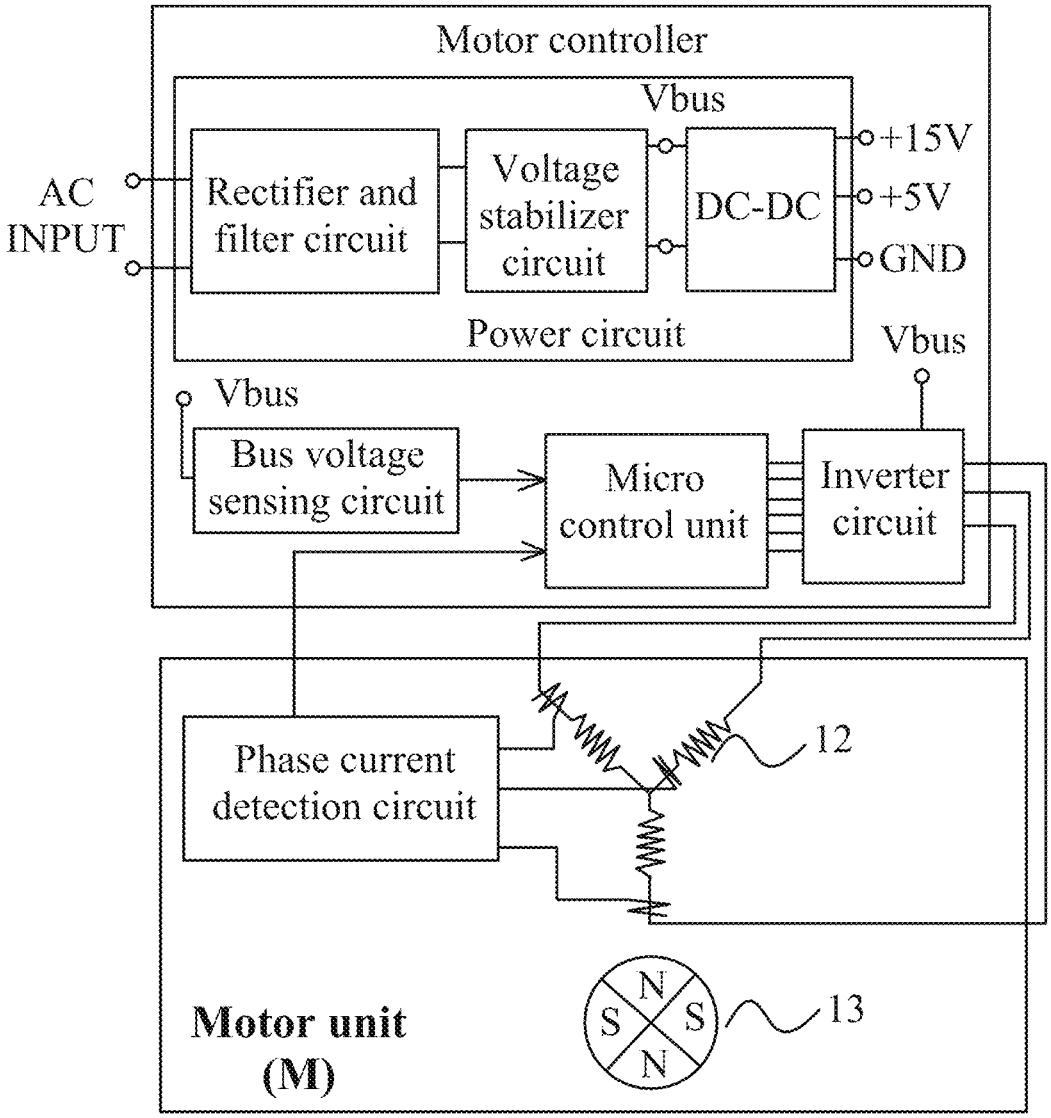
FIG. 7 is a circuit block diagram of a motor controller for a PM motor according to Example 1 of the disclosure.
Figure 8:
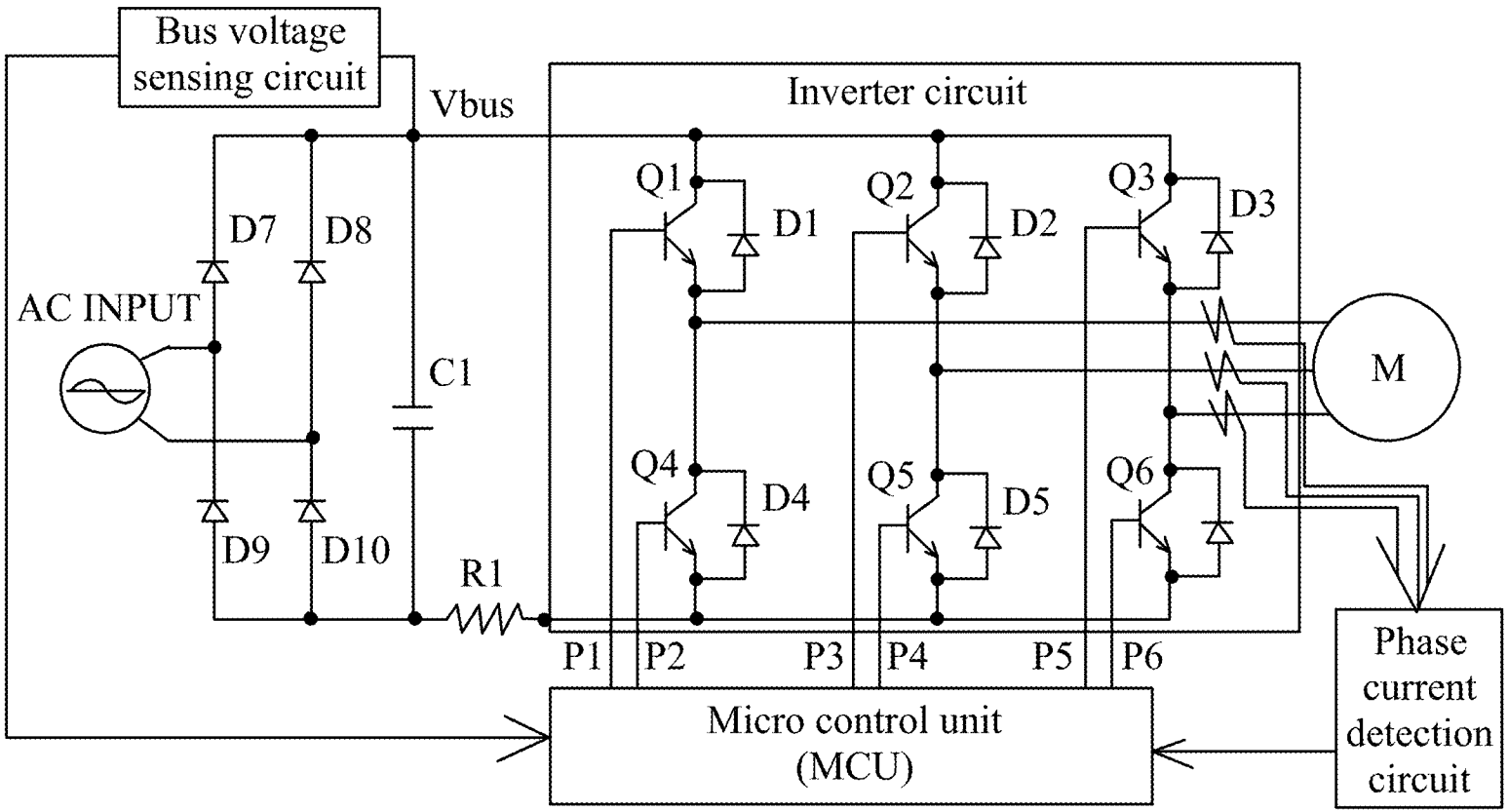
FIG. 8 is a circuit diagram for FIG. 7.

Referring to FIGS. 6, 7, and 8, the PM motor is a sensorless brushless DC motor, specifically a three-phase sensorless brushless DC permanent-magnet synchronous motor with three-phase winding coils. A full-wave rectifier circuit comprises diodes D7, D8, D9, and D10, which are configured to convert input AC voltage into DC bus voltage Vbus. The DC bus voltage Vbus is output at one end of the capacitor C1 and is relative to the input AC voltage. The DC bus voltage Vbus remains constant once the AC input voltage is established. The line voltage P of the three-phase winding coils is the PWM chopper output voltage and is given by P=Vbus*V_D, where V_D is the duty cycle of the PWM signal input from the MCU to the inverter circuit. The inverter circuit comprises six electronic switches Q1, Q2, Q3, Q4, Q5, and Q6, respectively controlled by six PWM signals (P1, P2, P3, P4, P5, P6) output from the MCU. The inverter circuit is connected to a resistor R1 to detect the bus current I. The bus current I is converted by the bus current detection circuit and transmitted to the MCU.

The sensorless brushless DC motor operates using vector control, specifically Field-Oriented Control (FOC). The real-time input power and rotational speed of the motor can be calculated using a method as described in the following patents: U.S. Pat. No. 9,752,976 and CN201410042547.8. The two patents disclose the method for achieving constant airflow control of a PM motor through direct power control. The constant airflow control can also be implemented in a sensorless brushless DC motor that comprises Hall sensors for detecting the rotor position, and more detailed information about the method can be found in the two patents: U.S. Pat. No. 9,752,976 and CN201410042547.8.

The disclosure provides a first method for estimating the external static pressure by a PM motor using constant current control. For more detailed information on the constant airflow control technique, refer to the following two patents: U.S. Pat. No. 9,752,976 and CN201410042547.8.

The first method develops a mathematical model for estimating external static pressure using constant current control by a motor. The mathematical model comprises three system variables: the external static pressure (ESP), the input power (POWER), and the constant volumetric airflow rate (measured in units of Cubic Feet per Minute, CFM). Generally, a motor is used to drive the fan, generating a stable airflow by pushing the air into the air ducts. The process results in a constant volumetric airflow rate in the air ducts. By regulating the input power and the rotational speed, constant airflow control is achieved under specific external static pressure conditions.

Building upon the constant airflow control method disclosed in the two patents, U.S. Pat. No. 9,752,976 and CN201410042547.8, the external static pressure (ESP) can be mathematically expressed as a function of the constant volumetric airflow rate (CFM) and the input power (POWER). The function is expressed as follows:

$$ESP=F(CFM,\text{POWER}) \qquad \text{Function 1}$$

Figure 9:
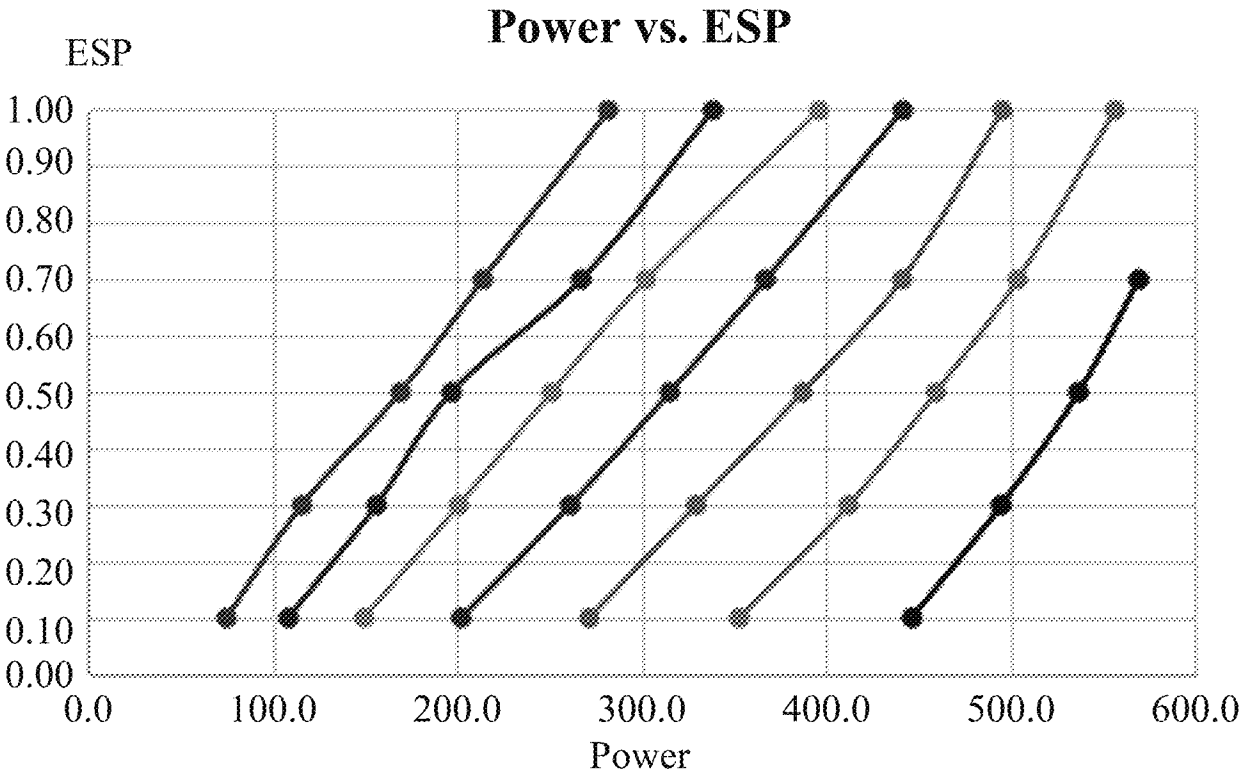
FIG. 9 is a graph illustrating the correlation between external static pressure (ESP) and input power (POWER) under constant airflow control conditions according to one example of the disclosure.

In the process of mathematical modeling, the data collected during the development of the method disclosed in the two patents, U.S. Pat. No. 9,752,976 and CN201410042547.8, is used to minimize the burden of data collection. FIG. 9 is a graph illustrating the correlation between the input power (POWER) and the external static pressure (ESP). Under specific operating conditions, a linear relationship between the input power (POWER) and the external static pressure (ESP) exists, allowing for more accurate modeling and estimation.

Figure 10:
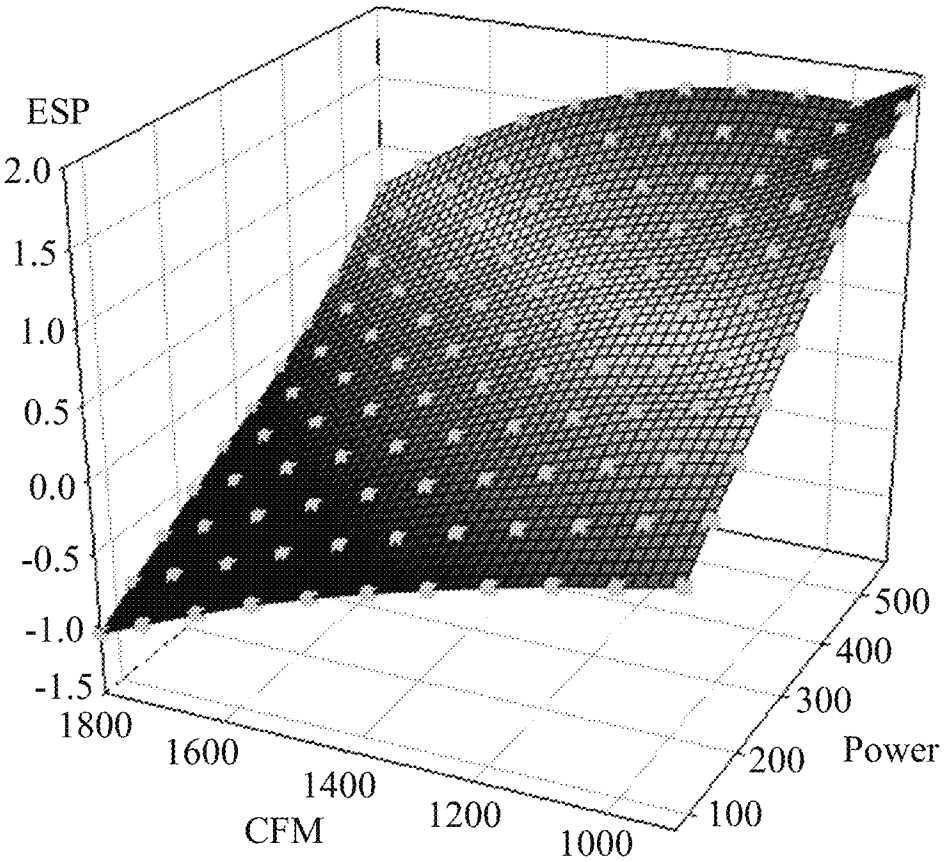
FIG. 10 is a three-dimensional graph illustrating the correlation among external static pressure (ESP), input power (POWER), and volumetric airflow rate (CFM) according to one example of the disclosure.

FIG. 10 is a three-dimensional graph illustrating the correlation among the external static pressure (ESP), the input power (POWER), and the volumetric airflow rate (CFM). The three-dimensional simulation graph provides the foundation for mathematical modeling.

Figure 2:
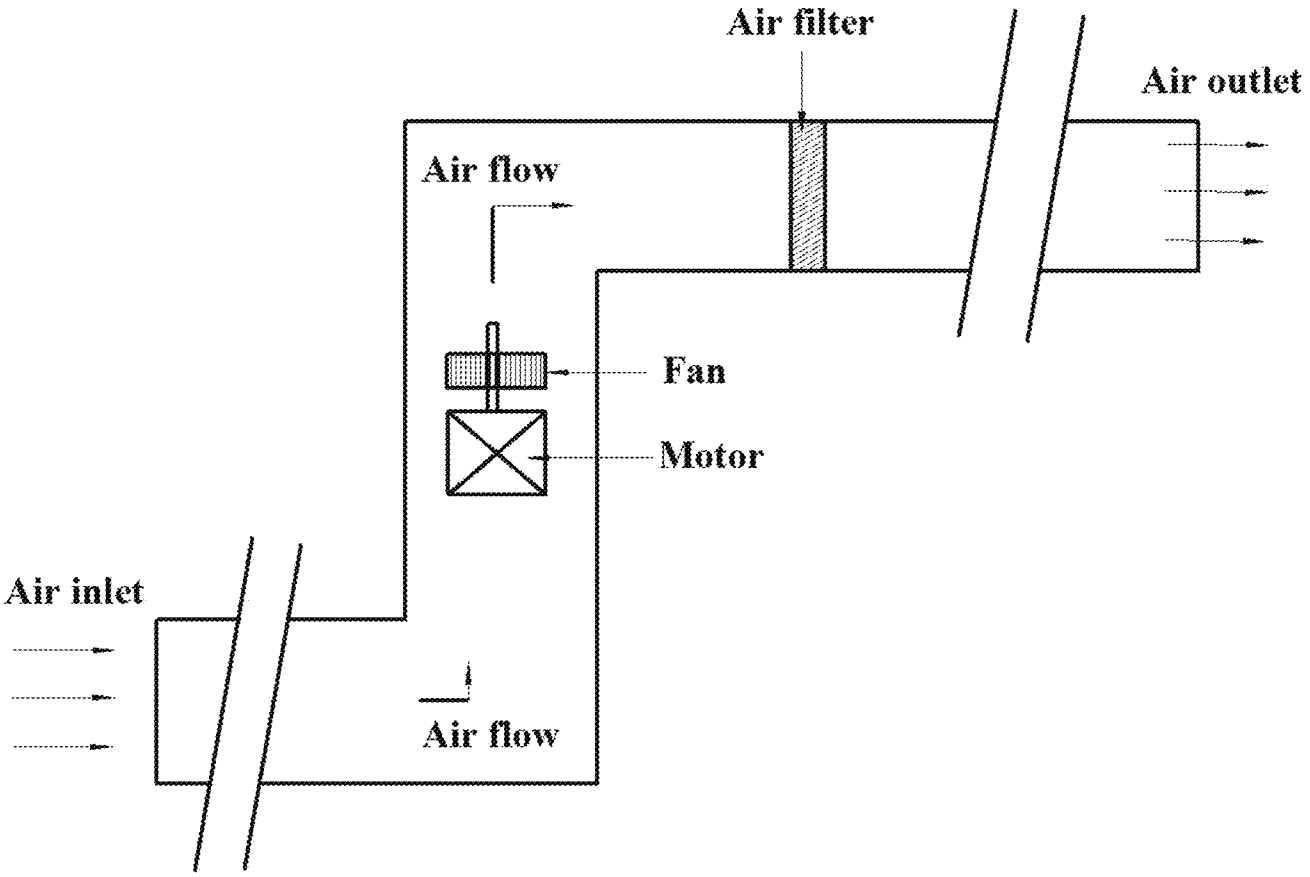
FIG. 2 (Prior art)
FIG. 2 is a schematic diagram of a branch air duct in FIG. 1.
Figure 3:
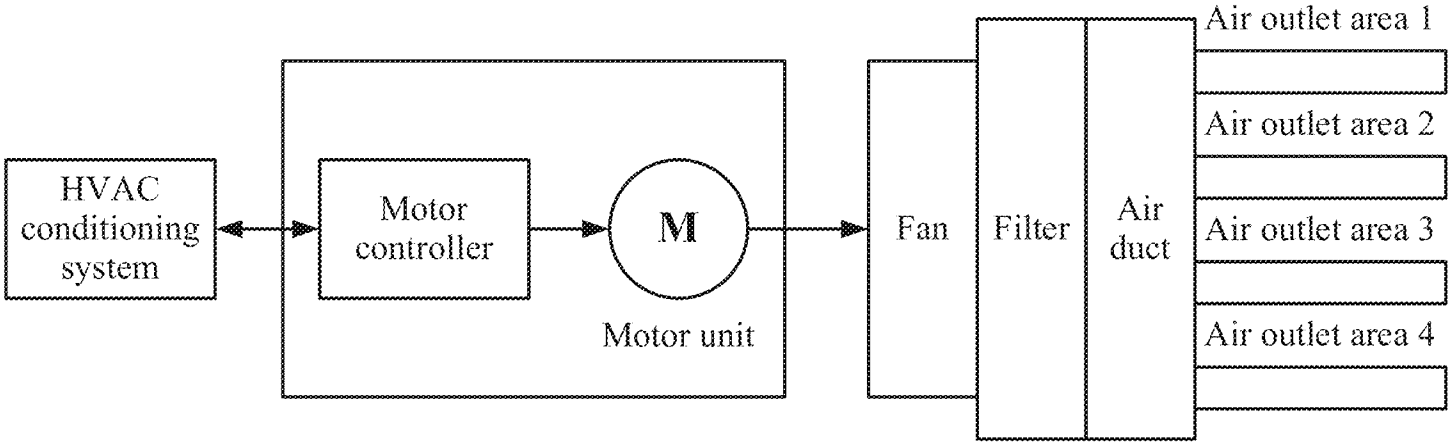
FIG. 3 is an installation schematic diagram of a PM motor according to one embodiment of the disclosure.
Figure 4:
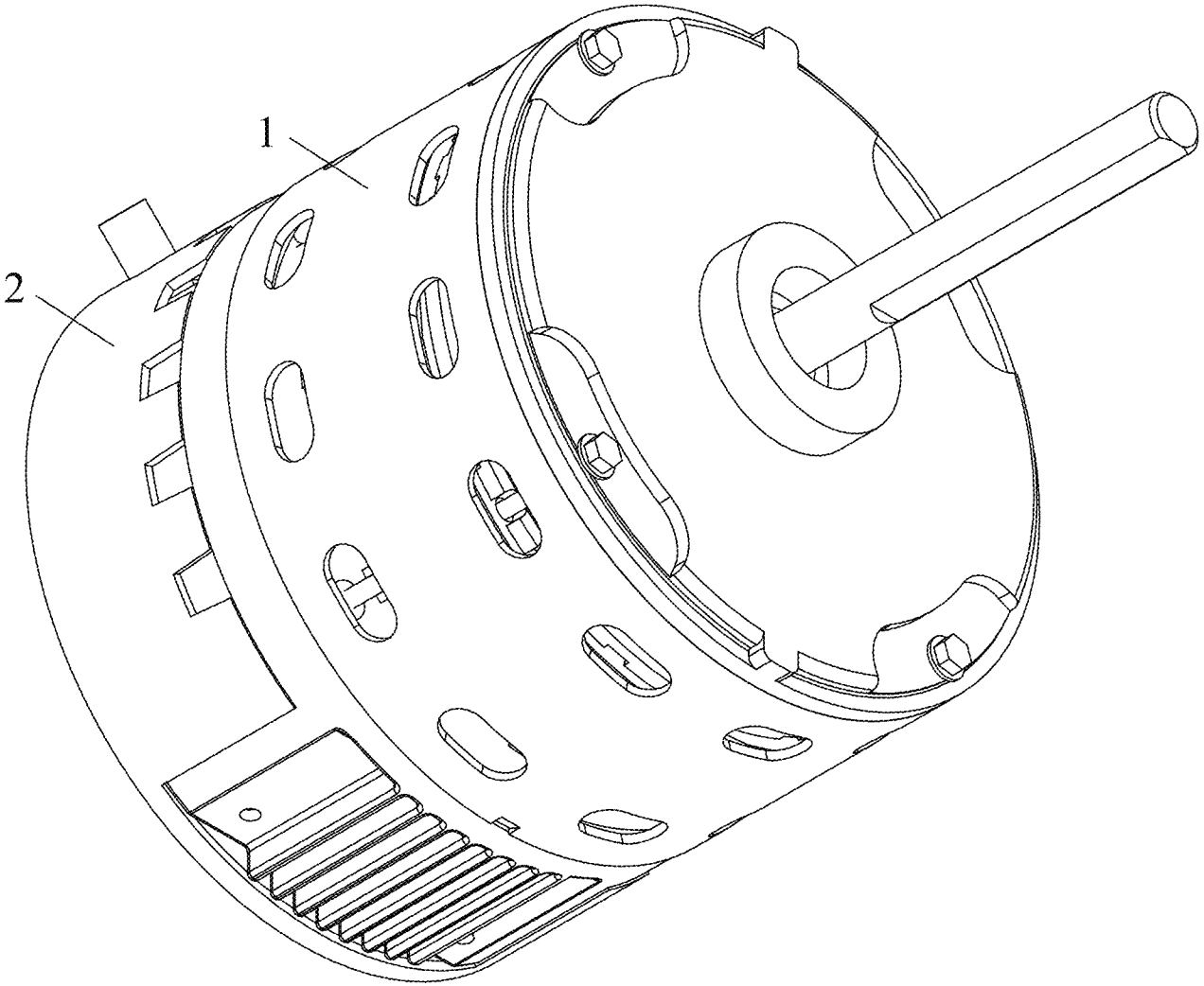
FIG. 4 is a perspective view of a PM motor according to one embodiment of the disclosure.
Figure 5:
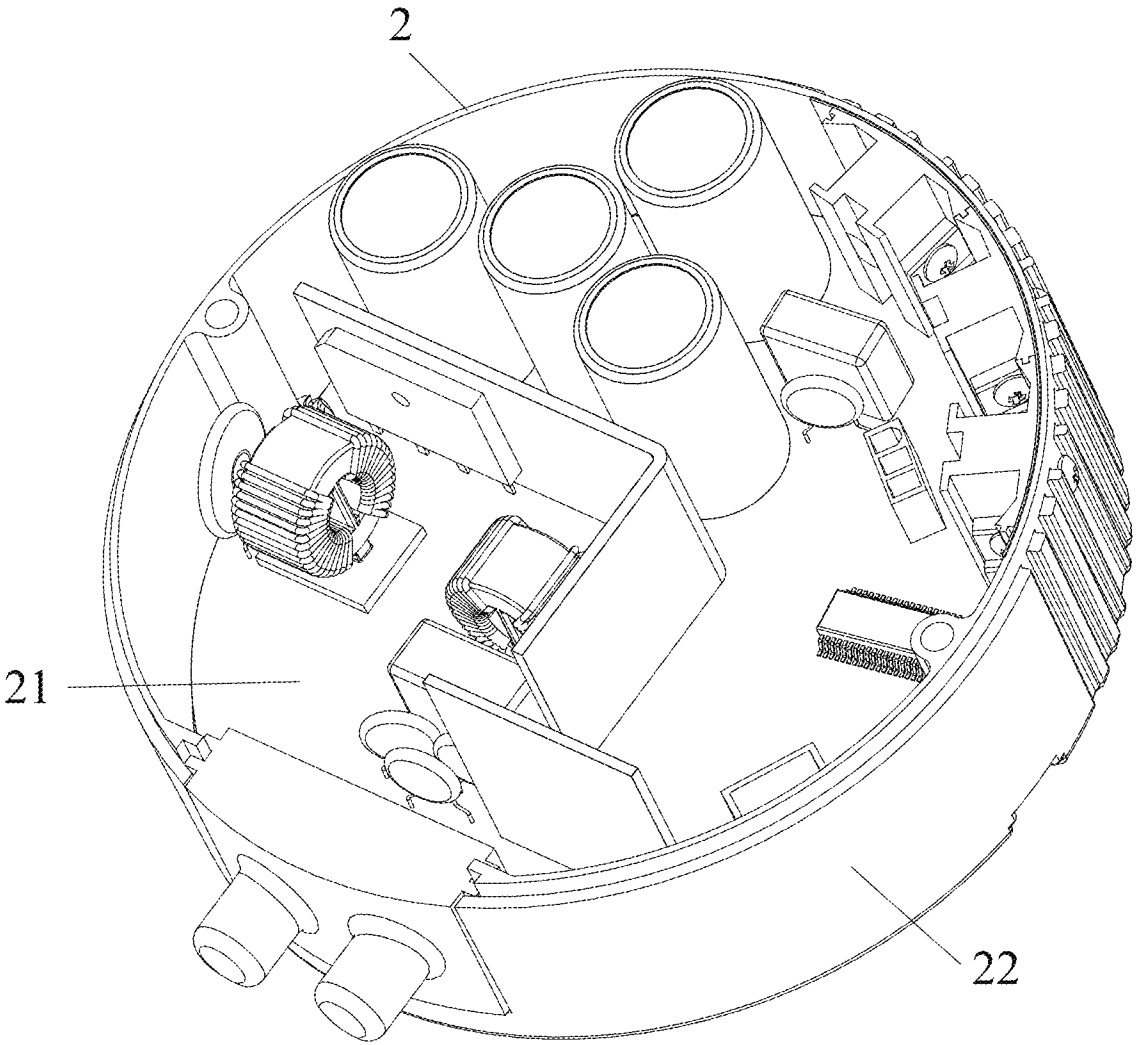
FIG. 5 is a perspective view of a motor controller for a PM motor according to one embodiment of the disclosure.

All the variables and the characteristic curves in FIGS. 1 and 2 are used for conducting statistical analysis on the static data, aiming to assess the independence and correlation. Use of nonlinear regression methods is essential in mathematical modeling. To reduce the computational burden on the MCU, the model is limited to a few parameters based on the specifications of product development and application programs. A specialized model function is developed through nonlinear regression practices to accommodate the non-smooth curve depicted in FIG. 1. The specialized model function incorporates two independent variables, the input power (POWER), and the constant volumetric airflow rate (CFM), resulting in the following simplified function:

$$F(X,Y,K)=K0+K1\cdot X+K2\cdot Y+K3\cdot X\cdot Y \qquad \text{Function 2}$$

where, the variable X is the constant volumetric airflow rate (CFM); the variable Y is the input power (POWER); K0, K1, K2, and K3 are coefficients; F(X, Y, K) is the external static pressure (ESP). Utilization of the simplified function alleviate the computational burden on the MCU, enhancing the efficiency and performance of the model.

The constant airflow control is achieved through direct power control (as described in the two patents U.S. Pat. No. 9,752,976 and CN201410042547.8). Four experimental data points (ESP1, POWER1, CFM1), (ESP2, POWER2, CFM2), (ESP3, POWER3, CFM3), and (ESP4, POWER4, CFM4) are substituted into the Function 2 to form a system of equations. By solving the system of equations, the coefficients K0, K1, K2, and K3 are determined. This forms the mathematical model for estimating the external static pressure using constant current control by a PM motor. Under constant airflow control, the external static pressure (ESP) is dependent on the input power (POWER) and the constant volumetric airflow rate (CFM) for any given value.

The first method comprises calculating the external static pressure (ESP) on the air duct using two variables: the constant volumetric airflow rate (CFM) and the input power (POWER). Specifically, a PM motor and a fan are disposed in the air duct; the PM motor comprises a stator assembly, a permanent-magnet rotor assembly, and a motor controller; the motor controller comprises a MCU; the fan is powered by the PM motor; and the PM motor operates using constant current control to ensure a constant volumetric airflow rate (CFM) within the air duct.

A function for estimating the external static pressure (ESP), expressed as ESP=F(CFM, POWER), is a first-order binary equation.

Four experimental data points (ESP1, POWER1, CFM1), (ESP2, POWER2, CFM2), (ESP3, POWER3, CFM3), and so on are substituted into the function ESP=F(POWER, CFM) to form a system of equations. By solving the system of equations, the coefficients K0, K1, K2, and K3 are determined.

The first-order binary equation is simplified as follows:

$$F(X,Y,K)=K0+K1\cdot X+K2\cdot Y+K3\cdot X\cdot Y$$

where the variable X is the constant volumetric airflow rate (CFM); the variable Y is the input power (POWER); K0, K1, K2, and K3 are coefficients; F(X, Y, K) is the external static pressure (ESP).

The constant airflow control is achieved through direct power control to ensure a constant volumetric airflow rate within the air conditioning system. In other words, the constant volumetric airflow rate (CFM) is determined by the function F(POWER, V), where POWER is the input power and V is the rotational speed of the PM motor.

The effectiveness of the first method is verified through experimental data, as shown in Table 1.

TABLE 1

| Constant volumetric airflow rate (CFM) | Input power (POWER) | Measured external static pressure (ESP) | Estimated external static pressure (ESP) | Error (ERR) |
|---|---|---|---|---|
| 900 | 75.0 | 0.10 | 0.125 | 0.025 |
| 900 | 116.0 | 0.30 | 0.306 | 0.006 |
| 900 | 169.3 | 0.50 | 0.542 | 0.042 |
| 898 | 214.0 | 0.70 | 0.743 | 0.043 |
| 900 | 282.0 | 1.00 | 1.041 | 0.041 |
| 1053 | 108.7 | 0.10 | 0.074 | −0.026 |
| 1054 | 156.3 | 0.30 | 0.275 | −0.025 |
| 1046 | 197.0 | 0.50 | 0.458 | −0.042 |
| 1048 | 267.3 | 0.70 | 0.754 | 0.054 |
| 1053 | 338.7 | 1.00 | 1.049 | 0.049 |
| 1203 | 149.7 | 0.10 | 0.044 | −0.056 |
| 1202 | 201.0 | 0.30 | 0.254 | −0.046 |
| 1200 | 251.3 | 0.50 | 0.461 | −0.039 |
| 1201 | 302.3 | 0.70 | 0.666 | −0.034 |
| 1200 | 396.3 | 1.00 | 1.050 | 0.050 |
| 1350 | 202.3 | 0.10 | 0.049 | −0.051 |
| 1353 | 261.3 | 0.30 | 0.273 | −0.027 |
| 1350 | 315.3 | 0.50 | 0.487 | −0.013 |
| 1348 | 367.3 | 0.70 | 0.692 | −0.008 |
| 1350 | 441.7 | 1.00 | 0.977 | −0.023 |
| 1500 | 271.7 | 0.10 | 0.092 | −0.008 |
| 1502 | 329.7 | 0.30 | 0.303 | 0.003 |
| 1500 | 387.3 | 0.50 | 0.519 | 0.019 |
| 1500 | 441.3 | 0.70 | 0.718 | 0.018 |
| 1501 | 495.7 | 1.00 | 0.917 | −0.083 |
| 1650 | 353.0 | 0.10 | 0.151 | 0.051 |
| 1650 | 412.3 | 0.30 | 0.360 | 0.060 |
| 1650 | 459.7 | 0.50 | 0.526 | 0.026 |
| 1650 | 504.0 | 0.70 | 0.681 | −0.019 |
| 1800 | 537.0 | 0.50 | 0.523 | 0.023 |

The results of Table 1 indicate that the error between the measured ESP and the estimated ESP calculated using Equation 2 is within 0.06. Most of the errors fall below 0.04, which is considered acceptable since precise detection of external static pressure (ESP) is not explicitly required by the customers. The results also demonstrate the effectiveness of the first method. Moreover, the mathematical model minimizes the computational burden on the MCU, significantly reducing the processing demands. The external static pressure (ESP) is determined by two variables: the constant volumetric airflow rate (CFM) and the input power (POWER). The first method eliminates the requirement for extra static pressure measurement devices, and allows real-time estimation of the external static pressure (ESP). The estimated data enables a comprehensive understanding of the operational performance of the HVAC system and facilitates the implementation of appropriate control measures, all achieved without any additional costs or modifications to the product structure.

Example 2

As shown in FIG. 1, the disclosure further provides a method for controlling an air conditioning system, specifically a method for maintaining a constant airflow within the air conditioning system. The air conditioning system comprises a system controller and a plurality of air ducts disposed at different locations; a plurality of PM motors is respectively disposed in the plurality of air ducts to power the corresponding fans; and a plurality of PM motors operate using constant current control to ensure a constant volumetric airflow rate (CFM) within the plurality of air ducts. The method comprises: measuring the external static pressure (ESP) on each air duct by the PM motor using the method as described in Example 1; transmitting the data of the external static pressure (ESP) to the system controller; and analyzing the data to regulate the air conditioning system to maintain a constant volumetric airflow rate (CFM).

The system controller is configured to receive the date of the external static pressure (ESP) measured by the plurality of PM motors and provides appropriate instructions to maintain a constant volumetric airflow rate (CFM) within the plurality of air ducts.

Example 3

As shown in FIG. 1, the disclosure further provides a method for controlling an air conditioning system, specifically a method for determining if a filter is clogged and requires replacement in the air conditioning system. The air conditioning system comprises a system controller and a plurality of air ducts disposed at different locations; a plurality of PM motors is respectively disposed in the plurality of air ducts to power the corresponding fans; and the plurality of PM motors operates using constant current control to ensure a constant volumetric airflow rate (CFM) in the air ducts. The method comprises: disposing a plurality of filters in the plurality of air ducts, respectively; measuring the external static pressure (ESP) on each air duct by the PM motor using the method as described in Example 1; transmitting the data of the external static pressure (ESP) to the system controller; and analyzing the data to determine if the filters are clogged and require replacement.

When the data of the external static pressure ESP measured by one of the plurality of PM motors, under a constant volumetric airflow rate (CFM) and a specific input power (POWER), exceeds a preset static pressure threshold (ESP-max), the system controller issues an alarm signal to indicate that a filter at a certain location is clogged and requires replacement.

The system controller records an initial external static pressure during the replacement of a new filter, enabling future big data analysis using the recorded data to identify a potential fault location.

By monitoring and measuring the changes in external static pressure (ESP) in the air ducts, the level of filter clogging can be determined. The method helps to prevent the replacement of the filters that are not yet clogged, thereby reducing unnecessary expenses.

Example 4

The disclosure further provides a method for controlling an air conditioning system, specifically a method for determining if any faults exist within the air conditioning system. The air conditioning system comprises the system controller and the plurality of air ducts disposed at different locations; the plurality of PM motors is respectively disposed in the plurality of air ducts to power the corresponding fan; the plurality of PM motors operate using constant current control to ensure a constant volumetric airflow rate (CFM) within the plurality of air ducts. The method comprises: measuring the external static pressure (ESP) on each air duct by the PM motor using the method as described in Example 1; transmitting the data of the external static pressure (ESP) to the system controller; and analyzing the data to determine if any faults exist within the air conditioning system.

The system controller is configured to receive the real-time date of the external static pressure (ESP) measured by the plurality of PM motors; and the data is analyzed using big data techniques to identify any faults within the air conditioning system.

Specifically, the PM motor supplies the data of the external static pressure (ESP) on the plurality of air ducts to the system controller. The data is transmitted remotely through the Internet of Things (IoT) to a centralized computer center for analysis. The process facilitates remote monitoring and enhances the significance of ESP feedback, particularly in commercial environments.

It will be obvious to those skilled in the art that changes and modifications may be made, and therefore, the aim in the appended claims is to cover all such changes and modifications.

What is claimed is:

1. A method for estimating an external static pressure (ESP) in an air duct the method comprising:

disposing a permanent magnetic (PM) motor and a fan in an air duct, wherein the PM motor comprises a stator assembly, a permanent-magnet rotor assembly, and a motor controller:

the motor controller comprises a micro control unit (MCU); and the fan is powered by the PM motor;

applying a constant current to the PM motor so that the air duct outputs a constant volumetric airflow rate in a unit of cubic feet per minute (CFM); and calculating an external static pressure (ESP) on the air duct using two variables: the constant volumetric airflow rate of the air duct and an input power (POWER) of the PM motor;

wherein:

the external static pressure (ESP) on the air duct is calculated using a function of a first-order binary equation: ESP=F(CFM, POWER):

the first-order binary equation is simplified as follows: $F(X, Y, K)=K0+K1\cdot X+K2\cdot Y+K3\cdot X\cdot Y$, where a variable X is the constant volumetric airflow rate (CFM): a variable Y is the input power (POWER): K0, K1, K2, and K3 are coefficients; and F(X, Y, K) is the external static pressure (ESP); and the constant volumetric airflow rate (CFM) is determined by a function CFM=F(POWER, V), where POWER is the input power and V is a rotational speed of the PM motor, wherein the system controller is configured to receive the data of the external static pressures (ESPs) measured by PM motors at different locations and provides appropriate instructions to the PM motors to maintain a constant volumetric airflow rate (CFM) within the plurality of air ducts.

2. A method for controlling a constant volumetric airflow rate of an air conditioning system, the air conditioning system comprising a system controller and a plurality of air ducts disposed at different locations; the method comprising:

disposing a permanent magnetic (PM) motor and a fan in each air duct, and the fan being powered by the PM motor; applying a constant current to the PM motor so that the each air duct outputs a constant volumetric airflow rate in a unit of cubic feet per minute (CFM);

calculating an external static pressure (ESP) on the each air duct using two variables:

the constant volumetric airflow rate (CFM) of the each air duct and an input power (POWER) of the PM motor;

wherein the external static pressure (ESP) on the each air duct is calculated using a function of a first-order binary equation: ESP=F(CFM, POWER): the first order binary equation is simplified as follows: $F(X, Y, K)=K0+K1\cdot X+K2\cdot Y+K3\cdot X\cdot Y$ wherein a variable X is the constant volumetric airflow rate (CFM); a variable Y is the input power (POWER); K0, K1, K2, and K3 are coefficients; and F(X, Y, K) is the external static pressure (ESP); and the constant volumetric airflow rate (CFM) is determined by a function CFM=F(POWER, V), where POWER is the input power and V is a rotational speed of the PM motor transmitting data of the external static pressures (ESPs) of the plurality of air ducts to the system controller; and analyzing the data to maintain a constant volumetric airflow rate within the plurality of air ducts within the air conditioning system, wherein the system controller is configured to receive the data of the external static pressures (ESPs) measured by PM motors at different locations and provides appropriate instructions to the PM motors to maintain a constant volumetric airflow rate (CFM) within the plurality of air ducts.

3. A method for determining whether a filter of an air conditioning system is clogged and requires replacement, the air conditioning system comprising a system controller and a plurality of air ducts disposed at different locations, and each air duct comprising a filter, the method comprising:

disposing a permanent magnetic (PM) motor and a fan in each air duct, and the fan being powered by the PM motor; applying a constant current to the PM motor so that the each air duct outputs a constant volumetric airflow rate in a unit of cubic feet per minute (CFM);

calculating an external static pressure (ESP) on the each air duct using two variables:

the constant volumetric airflow rate (CFM) of the each air duct and an input power (POWER) of the PM motor;

wherein the external static pressure (ESP) on the each air duct is calculated using a function of a first-order binary equation: ESP=F(CFM POWER)·the first order binary equation is simplified as follows: $F(X, Y, K)=K0+K1\cdot X+K2\cdot Y+K3\cdot X\cdot Y$, wherein a variable X is the constant volumetric airflow rate (CFM): a variable Y is the input power (POWER); K0, K1, K2, and K3 are coefficients; and F(X, Y, K) is the external static pressure (ESP); and the constant volumetric airflow rate (CFM) is determined by a function CFM=F(POWER, V), where POWER is the input power and V is a rotational speed of the PM motor;

transmitting data of the external static pressures (ESPs) of the plurality of air ducts to the system controller; and determining whether the filter of each air duct the in the air conditioning system is clogged and requires replacement according to the data of the external static pressures ESPs), wherein when the data of the external static pressure (ESP) measured by one of the plurality of PM motors under a certain constant volumetric airflow rate (CFM) and a specific input power (POWER) exceeds a preset static pressure threshold (ESPmax), the system controller issues an alarm signal to indicate that the filter of an air duct associated with the one of the plurality of PM motors at a certain location is clogged and requires replacement.

4. The method of claim 3, wherein during replacement with a new filter, the system controller records the data of the external static pressure (ESP) measured by the one of the plurality of PM motors under a certain constant volumetric airflow rate (CFM) and a specific input power (POWER) as an initial external static pressure, for future big data analysis to identify a potential fault location within the air conditioning system using the recorded data.

5. A method for determining whether a fault exists within an air conditioning system, the air conditioning system comprising a system controller and a plurality of air ducts disposed at different locations, and each air duct comprising a filter; the method comprising:

disposing a permanent magnetic (PM) motor and a fan in each air duct, and the fan being powered by the PM motor; applying a constant current to the PM motor so that the each air duct outputs a constant volumetric airflow rate in a unit of cubic feet per minute (CFM);

calculating an external static pressure (ESP) on the each air duct using two variables:

the constant volumetric airflow rate (CFM) of the air duct and an input power (POWER) of the PM motor;

wherein the external static pressure (ESP) on the each air duct is calculated using a function of a first-order binary equation: ESP=F(CFM, POWER), the first-order binary equation is simplified as follows: $F(X, Y, K)=K0+K1\cdot X+K2\cdot Y+K3\cdot X\cdot Y$, wherein a variable X is the constant volumetric airflow rate (CFM); a variable Y is the input power (POWER); K0, K1, K2, and K3 are coefficients; and F(X, Y, K) is the external static pressure (ESP); and the constant volumetric airflow rate (CFM) is determined by a function CFM=F(POWER, V), where POWER is the input power and V is a rotational speed of the PM motor;

transmitting data of the external static pressures (ESPs) of the plurality of air ducts to the system controller; and determining whether a fault exists within the air conditioning system according to the data of the external static pressures (ESPs), wherein the system controller is configured to receive real-time data of the external static pressures (ESPs) measured by the plurality of PM motors; and the data is analyzed using big data techniques to identify any fault within the air conditioning system.

* * * * *